US011692273B2

(12) United States Patent
Peters et al.

(10) Patent No.: US 11,692,273 B2
(45) Date of Patent: Jul. 4, 2023

(54) METHOD FOR APPLYING A TITANIUM ALUMINIDE ALLOY, TITANIUM ALUMINIDE ALLOY AND SUBSTRATE COMPRISING A TITANIUM ALUMINIDE ALLOY

(71) Applicant: Lufthansa Technik AG, Hamburg (DE)

(72) Inventors: Jan Oke Peters, Hamburg (DE); Thomas Maria Gartner, Hamburg (DE); Matthias Mecklenburg, Hamburg (DE); Marcus Willi Rackel, Drage / ot Schwinde (DE); Emine Bakan, Juelich (DE); Georg Mauer, Toenisvorst (DE)

(73) Assignee: LUFTHANSA TECHNIK AG, Hamburg (DE)

( * ) Notice: Subject to any disclaimer, the term of this patent is extended or adjusted under 35 U.S.C. 154(b) by 413 days.

(21) Appl. No.: 16/770,074

(22) PCT Filed: Dec. 6, 2018

(86) PCT No.: PCT/EP2018/083736
§ 371 (c)(1),
(2) Date: Jun. 5, 2020

(87) PCT Pub. No.: WO2019/110707
PCT Pub. Date: Jun. 13, 2019

(65) Prior Publication Data
US 2021/0071305 A1 Mar. 11, 2021

(30) Foreign Application Priority Data
Dec. 7, 2017 (DE) ..... 10 2017 222 182.8

(51) Int. Cl.
*C23C 24/08* (2006.01)
*C22C 14/00* (2006.01)
*C22F 1/18* (2006.01)

(52) U.S. Cl.
CPC ..... *C23C 24/087* (2013.01); *C22C 14/00* (2013.01); *C22F 1/183* (2013.01)

(58) Field of Classification Search
CPC ..... C23C 24/087; C23C 24/106; C23C 24/08; C23C 30/00; C22C 14/00; C22F 1/183
See application file for complete search history.

(56) References Cited

U.S. PATENT DOCUMENTS 5,837,387 A 11/1998 Brady et al.
6,905,728 B1 6/2005 Hu et al.
(Continued)

FOREIGN PATENT DOCUMENTS

CN 102303117 A 1/2012
CN 106493348 A 3/2017
(Continued)

OTHER PUBLICATIONS

M. Karadge, "Metastable phase formation during α2 (D019) to (L10) transformation in as-atomized-TiAl alloy powders", Appl. Phys. Lett. 85, 4914 (2004) (Year: 2004).*
(Continued)

*Primary Examiner* — Brian D Walck
*Assistant Examiner* — Nazmun Nahar Shams
(74) *Attorney, Agent, or Firm* — Leydig, Voit & Mayer, Ltd.

(57) ABSTRACT

A method applies a titanium aluminide alloy on a substrate. The titanium aluminide alloy has a gamma phase proportion of at least 50% based on an overall composition of the titanium aluminide. The method includes: pretreating a surface of the substrate; heat treating titanium aluminide
(Continued)

powder particles at a temperature range of 600° C. to 1000° C. to increase the proportion of the gamma phase; cold spraying the heat-treated powder particles onto the substrate or a part of the substrate to form a layer of titanium aluminide; and thermally post-treating the layer of titanium aluminide applied to the substrate.

18 Claims, 1 Drawing Sheet

(56) References Cited

U.S. PATENT DOCUMENTS

| | | | | |
|---|---|---|---|---|
| 2015/0283642 | A1 | 10/2015 | Forsdike et al. | |
| 2016/0145728 | A1* | 5/2016 | Schaeffer | C22C 21/00 428/650 |

FOREIGN PATENT DOCUMENTS

| | | | |
|---|---|---|---|
| EP | 2333134 | A1 | 6/2011 |
| EP | 2584056 | A1 | 4/2013 |

OTHER PUBLICATIONS

Hautmann, D.: "Titanluminid—das Beste aus zwei Welten", Aeroreport—das Luftfahrtmagazin der MTU Aero Engines, Dec. 2013, pp. 25-29.

M. Gizynski, et al., "Formation and subsequent phase evolution of metastable Ti—Al alloy coatings by kinetic spraying of gas atomized powders", Surface & Coatings Technology 315 (2017), Feb. 21, 2017, pp. 240-249.

* cited by examiner

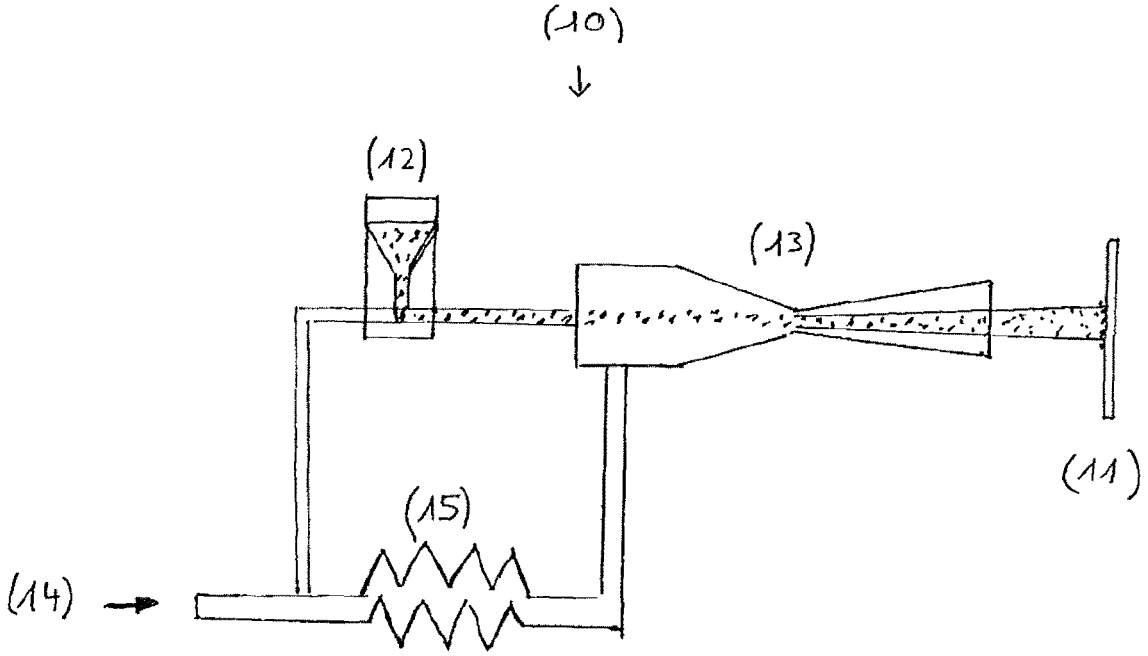
(10)
(12)
(13)
(11)
(15)
(14)

METHOD FOR APPLYING A TITANIUM ALUMINIDE ALLOY, TITANIUM ALUMINIDE ALLOY AND SUBSTRATE COMPRISING A TITANIUM ALUMINIDE ALLOY

CROSS-REFERENCE TO PRIOR APPLICATIONS

This application is a U.S. National Phase Application under 35 U.S.C. § 371 of International Application No. PCT/EP2018/083736, filed on Dec. 6, 2018, and claims benefit to German Patent Application No. DE 10 2017 222 182.8, filed on Dec. 7, 2017. The International Application was published in German on Jun. 13, 2019 as WO 2019/110707 A1 under PCT Article 21(2).

FIELD

The present invention relates to a method for the application of a titanium aluminide alloy to a substrate, a titanium aluminide alloy produced in accordance with such a method and a substrate comprising such a titanium aluminide alloy.

BACKGROUND

When repairing components made of titanium aluminide alloys with a predominant proportion of gamma phase, generally the same or related material, i.e. a filler material from the group of titanium aluminide alloys with a predominant proportion of gamma phase, is applied by means of fusion welding processes. An example of this is the laser powder fusion welding process.

A significant disadvantage of the fusion welding processes used to date is the tendency to lead to changes in the structure and the phase as well as the formation of pores and stress cracks due to very high process temperatures and cooling rates. Furthermore, these processes can lead to undesired absorption of impurities, such as oxygen and nitrogen, not only in the base material but also in the weld metal.

The publication by Gizynski et al., "Formation and subsequent phase evolution of metastable Ti—Al alloy coatings by kinetic spraying of gas atomized powders," Surface & Coating Technology, 2017, 315, 240-249, discloses the use of a titanium aluminide alloy (Ti—48Al—8.5Nb-1Ta (At. %)) for the production of an oxidation protection layer on a titanium substrate (IMI-834), which is applied by means of a warm spray method. The influence of the heat treatment on the alloy powder used is examined as well. For this purpose, gas-atomized alloy powder is compared with a similar, heat-treated alloy powder. It is concluded that the heat treatment of the alloy powder does not produce any significant advantage for the warm spray method.

EP 2 584 056 A1 discloses the use of the cold spray method with a powder of titanium aluminide with a gamma/alpha2 structure to form a layer of a titanium aluminide alloy with a fine structure of gamma and alpha2 phase components. The relatively large proportion of the alpha2 phase to the gamma phase present in the powder is converted by a heat treatment downstream of the coating.

EP 2 333 134 A1 describes a cold spray method in which a mixture of aluminum and titanium powder particles are sprayed together. A titanium aluminide alloy with a gamma phase is formed through a subsequent heat treatment. Such a method is also described in the publication by Novoselova et al., Formation of TiAl intermetallics by heat treatment of cold-sprayed precursor deposits, Journal of Alloys and Compounds, 2007, 436, 69-77.

Sabard et al., Solution heat treatment of gas atomized aluminum alloy (7075) powders: microstructural changes and resultant mechanical properties, DVS-reports, 2017, 336, 766-771, describes a heat treatment of atomized powder particles of an aluminum alloy for the adjustment of a more ductile structure.

These publications show that cold gas coating methods are very challenging. A disadvantage of the known cold spray methods is that the titanium aluminide alloys applied by means of these methods to the substrate with a predominant proportion of the gamma phase do not adequately adhere to the substrates. The coating efficiencies (deposition efficiency (DE)) that are achieved with this method are therefore extremely low. In addition, the titanium aluminide alloy layers that are created lack the corresponding physical properties such as sufficient ductility, high mechanical strength and a low defect density (adhesion defects, pores and cracks). Thus, these processes cannot be used for the demanding coatings of, for example, aircraft, gasoline engines, diesel engines and stationary gas turbine components. Industrial applications in which layers of titanium aluminide alloys with a predominant proportion of the gamma phase are applied by means of a cold spray method to substrates with at least one substrate surface made of titanium aluminide alloys, which also have high proportions of the gamma phase, are not known from prior art.

SUMMARY

An embodiment of the present invention provides a method that applies a titanium aluminide alloy on a substrate. The titanium aluminide alloy has a gamma phase proportion of at least 50% based on an overall composition of the titanium aluminide. The method includes: pretreating a surface of the substrate; heat treating titanium aluminide powder particles at a temperature range of 600° C. to 1000° C. to increase the proportion of the gamma phase; cold spraying the heat-treated powder particles onto the substrate or a part of the substrate to form a layer of titanium aluminide; and thermally post-treating the layer of titanium aluminide applied to the substrate.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following:

FIG. 1 schematically a device for performing the method according to the invention according to one embodiment.

DETAILED DESCRIPTION

The present invention provides a method for applying a titanium aluminide alloy with a predominant proportion of the gamma phase to a substrate. The method enables the application and production of well-adhering and dense cold spray layers from titanium aluminide alloys with a predominant proportion of the gamma phase on a substrate. In particular, the method according to an embodiment of the invention enables the application of such titanium aluminide alloys to substrates made of related or similar titanium aluminide alloys or with related or identical layers of titanium aluminide alloy to the substrate surface. In particular, this allows for the repair of such related or similar titanium aluminide alloys as well as the substrates themselves. Embodiments of the present invention also provide a titanium aluminide alloy produced with the method, according to embodiments of the invention, and a substrate having such a titanium aluminide alloy.

The present invention provides, for example, a method for the application of a titanium aluminide alloy having a gamma phase proportion of at least 50% based on the overall composition of the titanium aluminide alloy on a substrate. The method may include the following steps:

a) Pretreatment of the substrate surface;
b) Heat treatment of titanium aluminide powder particles at a temperature range from 600 to 1000° C. in order to increase the proportion of the gamma phase;
c) Cold spraying of the heat-treated powder particles onto the substrate or a part of the substrate to form a layer of titanium aluminide; and
d) Thermal post-treatment of the layer of titanium aluminide applied to the substrate.

Some terms used in the context of the invention are explained below.

In the context of the present invention, the term "titanium aluminide alloy" is used for the finished layer of titanium aluminide alloy applied by using the method according to the invention.

In the context of the present invention, the term "titanium aluminide layer" is, for the purpose of a better differentiation, used for the titanium aluminide layer, which is present on the substrate after the cold spraying and which has not yet been thermally after-treated. According to the invention, however, this may also be a titanium aluminide alloy.

In the context of the present invention, the term "powder particles made of titanium aluminide" is, for a better differentiation, used for the powder particles made of titanium aluminide before, during, and after the heat treatment. According to the invention, however, these may also be titanium aluminide alloys.

Titanium aluminides or titanium aluminide alloys are compounds that include at least the metals titanium (Ti) and aluminum (Al). The titanium aluminides or titanium aluminide alloys preferably have additional alloy elements, such as chromium (Cr), silicon (Si), vanadium (V), zircon (Zr), niobium (Nb), boron (B), carbon (C), tungsten (W), molybdenum (Mo), yttrium (Y), cerium (Ce), hafnium (Hf), iron (Fe), nickel (Ni) or tantalum (Ta). Even small amounts of additional alloying elements can significantly improve the mechanical properties and the structural properties of the finished titanium aluminide alloys.

Different phase constitutions may occur in titanium aluminides or titanium aluminide alloys. On the one hand, there are the high temperature phases alpha and beta. Then there are the gamma, alpha2, and betaO phases, which are present as intermetallic titanium aluminide compounds. The term gamma phase (gamma titanium aluminide) refers to the tetragonal gamma (TiAl) phase with an L10 structure. The term alpha2 phase refers in the context of the present invention to the hexagonal alpha2 (Ti3Al) phase with a D019 structure. The term betaO refers to the ordered cubically primitive betaO (TiAl) phase with a B2 structure. Furthermore, there are the ordered omegaO phase with a B82 structure and the orthorhombic 0 phase (Ti2AlNb) with a A2BC structure. Depending on the additional alloying elements and alloying contents that were selected, additional phases, which are often related with respect to their crystallography, may form. The circumstances surrounding the formation of these phases are the subject of current research.

In the context of the present invention, the term "titanium aluminide alloy with a pre-dominant proportion of the gamma phase" refers to a titanium aluminide alloy with a gamma phase proportion of at least 50% based on the overall composition of the titanium aluminide alloy. The percentages (%) used in connection with the invention for the proportions of the individual phases are to be understood as volume percentages (vol. %).

Furthermore, it should be noted that in the context of the present invention, the method steps a) pretreatment of the substrate surface, and b) heat treatment of titanium aluminide powder particles can also be carried out in the reverse order or simultaneously.

The invention has the advantage that the method according to the invention enables the application of ductile, well-adhering, and dense cold spray layers from titanium aluminide alloys, with a predominant proportion of the gamma phase on a substrate. In particular, the method according to the invention can be used to apply to the substrate surface titanium aluminide alloys with a predominant proportion of the gamma phase to substrates made of related or similar titanium aluminide alloys or with related or similar titanium aluminide alloy layers. As a result, the method according to the invention can be used for not only the repair of components with such titanium aluminide alloys but also the assembly of components.

The invention has recognized that the heat treatment of the titanium aluminide powder particles in a temperature range from 600 to 1000° C. leads to a phase conversion of the alpha and beta phase, and in particular, also a conversion of the ordered alpha2 phase to the gamma phase even before the actual coating step takes place. This significantly increases the proportion of the ductile gamma phase in the powder used. A higher proportion of the ductile gamma phase in turn has the advantage that the coating efficiency (deposition efficiency (DE)) is significantly improved in cold spray methods. In addition, the thermal aftertreatment leads to an improved adhesive strength and fatigue strength of the titanium aluminide alloys produced. Such a thermal aftertreatment is usually not carried out in the cold spray methods known from prior art. By combining the method steps according to the invention, the method according to the invention is much more efficient compared to the known cold spray coating methods.

The titanium aluminide alloy preferably has a gamma phase proportion of at least 55%, more preferably at least 60%, even more preferably 80% based on the overall composition of the titanium aluminide alloy.

The titanium aluminide alloy preferably has a beta phase proportion of less than 10%, more preferably of less than 5%, even more preferably of less than 2% based on the overall composition of the titanium aluminide alloy.

Preferably, the titanium aluminide alloy includes the gamma phase and the alpha2 phase. It is particularly preferred that the titanium aluminide alloy is present in a phase constitution that essentially consists of the gamma phase and the alpha2 phase.

It is further preferred that the titanium aluminide alloy comprises the gamma phase and the alpha2 phase and that a ratio of the gamma phase to the alpha2 phase is present in the titanium aluminide alloy in a range from 50:50 to 99:1, more preferably from 55:45 to 90:10, and even more preferably from 60:40 to 80:20. In a particular embodiment, the ratio of the gamma phase to the alpha2 phase is 80:20 in the titanium aluminide alloy.

In a further advantageous embodiment, the titanium aluminide alloy has a composition of Ti—48Al—2Nb—2Cr (At. %).

It is further preferred that the substrate has a substrate surface made of a metal alloy. Alternatively, it is preferred that the substrate consists (substantially) of the metal alloy. The metal alloy is preferably a metal alloy selected from a titanium aluminide alloy, a nickel alloy, a titanium alloy or combinations of these alloys. A titanium aluminide alloy or a combination of several titanium aluminide alloys is particularly preferred. A titanium aluminide alloy which comprises a predominant proportion of the gamma phase is even more preferred.

It is further preferred that the method according to the invention is used as a method for the repair of a metal alloy already present on a substrate or for the repair of the substrate itself. In a particularly preferred embodiment, the titanium aluminide alloy already present on the substrate is a titanium aluminide alloy, which has the same chemical composition as the titanium aluminide alloy which is applied to the substrate surface by means of the method.

It is preferably provided that the pretreatment of the substrate surface is selected from the polishing, roughness blasting, high pressure water blasting, chemical etching treatment options and combinations thereof. The substrate surface is activated by the pretreatment and thus prepared for the application of the powder particles using the cold spray method. The pretreatment ensures a significantly better adhesion of the applied layer of powder particles to the substrate.

Roughness blasting is to be understood in connection with the invention as the blasting of the substrate surface with solid particles. This causes the substrate surface to be coated to be roughened and cleaned. It is preferred that SiC, Al2O3 and/or a similar powder made of titanium aluminide is used as the blasting medium for the roughness blasting. The term "similar powder" refers to a powder with a chemical composition that is identical to that of the titanium aluminide alloy according to the invention.

In chemical etching, an alkaline solution is preferably applied to the substrate surface. In an alternative preferred embodiment, the substrate surface is treated with a gas that contains fluoride ions.

It is further preferred that the pretreatment of the substrate surface comprises a polishing of the substrate surface.

It is preferred that the heat treatment be carried out in a temperature range from 620 to 900° C., more preferably from 650 to 850° C. In a preferred embodiment, the temperature is 650° C.

The phase constitution of the titanium aluminide powder particles is influenced by the heat treatment of the powder particles in a temperature range from 600 to 1000° C. in such a way that the highest possible proportion of the ductile gamma phase is obtained. Higher temperatures preferably lead to a higher proportion of the ductile gamma phase. A high ductility of the powder particles is particularly advantageous for the impact of the powder particles on the substrate and thus for the entire coating process because the increased ductility of the powder particles leads to an increased plastic deformation of the powder particles when they strike the substrate surface. The increased plastic deformability then causes an increased adhesion of the powder particles to the substrate surface and an improved coating efficiency. This increase in adhesion is already noticeable not only at the start of the coating process but also during a further layer build-up.

It is preferably provided that the heat treatment of the powder particles takes place in a protective gas atmosphere or in a vacuum. In a preferred embodiment, the protective gas is argon or a mixture of argon and a reducing gas. A particularly preferred protective gas is a mixture of argon with 4% hydrogen.

It is further preferred that the heat treatment be carried out for a duration of 0.5 to 5 hours.

In a preferred variant of the invention, it is provided that the heat treatment is carried out for 1 to 3 hours in a protective gas atmosphere or in a vacuum of less than 10 mbar at a temperature range from 650 to 850° C.

In a preferred embodiment of the invention, it is provided that the heat treatment is carried out in a vacuum furnace.

A heat treatment in a vacuum or in a protective gas atmosphere made of argon offers the following advantages:

- The additional intake of oxygen, nitrogen or other impurities is reduced
- The evaporation of aluminum is minimized in a protective gas atmosphere so that the homogeneity of the alloy composition is maintained
- There is additional protection when handling the powder particles (lower risk of fire and explosion)
- If a suitable heat treatment vessel is used, the heat treatment can be carried out in a commercially available high-temperature furnace (which reduces the processing costs compared to a vacuum furnace).

The conditions of the heat treatment are preferably selected so that no disruptive bonds develop between the powder particles. In the event that loose bonds should develop regardless, it is preferred that these be broken up by a mechanical grinding and subsequent sieving process in an inert gas atmosphere.

It is further preferred that the heat treatment be carried out in an inert vessel. The use of a non-inert vessel is less suitable from a technical point of view because this may result in a contamination of the powder particles and, as a rule, the vessel then cannot be reused, which increases the processing costs even further. In addition, the use of an inert vessel may avoid an undesired supply of heat. This supply of heat may otherwise lead to an additional introduction of heat into the powder particles and thus result in an undesired phase and/or structural conversion.

It is further preferred that the powder particles are spherical in shape. It is further preferred that the powder particle surfaces have few or no satellite formations. In particular, it is preferred that the powder particles have a size in a range from 10 to 70 μm. As the powder particle size reduces, the proportion of a brittle alpha2 phase decreases further, in particular in the case of an alloy with the composition of Ti—48Al—2Nb—2Cr (at. %). In addition, smaller powder particles contribute to a better coating efficiency (Deposition Efficiency (DE)). However, it should also be noted that powder particles that are too small do not sufficiently adhere to the substrate. The above-mentioned shapes and sizes of the powder particles have the further advantage that they lead to a narrow speed distribution of the powder particles in the gas jet during cold spray.

In a further preferred embodiment of the invention, it is provided that the average powder particle diameter is less than 45 μm. A microstructure analysis of different powder particle fractions, for example an alloy with a composition of Ti—48Al—2Nb—2Cr (At. %), shows that the proportion of the brittle alpha2 phase decreases further with such powder particle diameters.

Furthermore, it should be noted that a change in the fraction sizes of the powder particles can significantly influence the sprayability of the powder particles during the cold spray. Powder particle fractions preferred according to the invention are, for example, a powder particle fraction in which 10 vol % of the powder particles is smaller than 29 μm, 50 vol % of the powder particles is smaller than 43 μm and 90 vol % of the powder particles is smaller than 61 μm (d10/d50/d90: 29/43/61 μm), a powder particle fraction in which 10 vol % of the powder particles is smaller than 8 μm, 50 vol % of the powder particles is smaller than 13 μm and 90 vol % of the powder particles is smaller than 19 μm (d10/d50/d90: 8/13/19 μm) and a powder particle fraction in which 10 vol % of the powder particles is smaller than 18 μm, 50 vol % of the powder particles is smaller than 43 μm and 90 vol % of the powder particles is smaller than 61 μm (d10/d50/d90: 18/43/61 μm). The powder particle fraction in which 10 vol % of the powder particles is less than 18 μm, 50 vol % of the powder particles is less than 43 μm and 90 vol % of the powder particles is less than 61 μm is particularly preferred (d10/d50/d90: 18/43/61 μm).

Furthermore, in the cold spray according to the invention, the powder particles are preferably applied at 20-60 mm intervals. A preferred delivery rate of the powder particles is around 10 to 50 g/min.

It is also preferred that a cold spray carrier gas is selected from nitrogen and a mixture of nitrogen and helium. It is further preferred that the carrier gas is preheated to a temperature of 700 to 1200° C., more preferably to a temperature of 950° C. to 1100° C. A preferred gas pressure is in the range of 40 to 50 bar.

It is preferred that the temperature of the powder particles when striking the substrate is in a temperature range of 640 to 825° C. A preferred powder particle speed in cold spray is in a range of 630 to 1000 m/s. However, the powder particle temperature and the powder particle speed are not adjustable process parameters but instead result from the type of gas, the gas pressure, the gas temperature as well as the respective physical and geometric properties of the powder particles and the geometric properties of the nozzle.

It is preferred that the layer of titanium aluminide comprises the gamma phase and the alpha2 phase prior to the thermal aftertreatment. In particular, it is preferred that the layer of titanium aluminide is in a phase constitution prior to the thermal aftertreatment that substantially consists of the gamma phase and the alpha2 phase.

It is preferred that the layer of titanium aluminide has a gamma phase proportion of at least 55% prior to the thermal aftertreatment, more preferably at least 60%, even more preferably 80% based on an overall composition of the layer of titanium aluminide.

It is preferred that the layer of titanium aluminide has a beta phase proportion of less than 10% after the thermal aftertreatment, more preferably less than 5%, even more preferably less than 2% based on the overall composition of the layer of titanium aluminide.

It is further preferred that a ratio of the gamma phase to the alpha2 phase in the titanium aluminide layer prior to the thermal aftertreatment is in a range from 50:50 to 99:1, more preferably from 55:45 to 90:10, even more preferably from 60:40 to 80:20. In a particular embodiment, the ratio of the gamma phase to the alpha2 phase is 80:20 in the layer of titanium aluminide prior the thermal aftertreatment.

It is preferred, according to the invention, that the thermal aftertreatment is a hot isostatic pressing (HIP). The hot isostatic pressing preferably takes place at a temperature between 1050 and 1300° C., more preferably at a temperature of about 1200° C. It is further preferred that the hot isostatic pressing is carried out at a pressure in the range of 1000 to 3000 bar, more preferably from 1700 to 2300 bar, and most preferably at 2000 bar. In a preferred embodiment, the hot isostatic pressing is carried out for 4 hours in an argon protective gas atmosphere at a temperature of 1200° C. and a pressure of 2000 bar.

Due to the relatively brittle powder particles in a layer of titanium aluminide or a titanium aluminide alloy, which mainly consists of the gamma phase, bonding defects in the form of cracks or increased porosity may occur at the interface with the substrate or during the further build-up of the coating. These defects can be healed (cracks) and closed (porosity) by hot isostatic pressing. Another advantage of hot isostatic pressing is the improved adhesion of the layer of powder particles applied to the substrate.

In an alternative embodiment, it is provided that the thermal aftertreatment is a diffusion annealing, which is preferably carried out in a temperature range from 700 to 1000° C. Furthermore, the diffusion annealing preferably takes place in a vacuum of $1\times10^{-6}$ to $1\times10^{-3}$ mbar, more preferably $5\times10^{-6}$ to $5\times10^{-4}$ mbar, most preferably $5\times10^{-6}$ to $1\times10^{-4}$ mbar. Diffusion annealing is particularly advantageous if the substrate has a certain structural state which is unsuitable for the higher temperatures used in isostatic pressing and which would result in undesirable structural changes, residual stress and geometric distortion. The diffusion annealing improves the adhesion of the applied layer to the substrate surface, and any defects in the layer that have arisen are healed. The residual porosity remaining after such a heat treatment is tolerated in such a case.

The invention further relates to a titanium aluminide alloy which is produced by the method according to the invention.

The invention also relates to a substrate comprising a layer of titanium aluminide alloy applied by the method according to the invention.

It is preferred that the substrate is an aircraft, gasoline engine, diesel engine or stationary gas turbine component.

The invention will now be described by way of example using some advantageous embodiments with reference to the accompanying drawing.

FIG. 1 schematically shows a device (10) with which the method according to the invention can be carried out. A substrate (11) is shown, the substrate surface of which was pretreated in a first step. Furthermore, a powder conveyor (12) is shown, via which the heat-treated titanium aluminide powder particles are conveyed into the device for cold spraying (13). The powder particles are preferably transported by using a carrier gas (14) consisting of nitrogen or nitrogen and helium, which is conveyed into the device at a pressure of preferably 40 to 50 bar. The carrier gas can be heated to a temperature of preferably 950 to 1100° C. in an additional heating device (15). The titanium aluminide powder particles hit the pretreated substrate (10) at a powder particle speed of preferably 630 to 1000 m/s. Subsequent to the coating using cold spraying, the substrate is then thermally post-treated in a further step.

Exemplary Embodiments

The method according to the invention for the application of a titanium aluminide alloy with a predominant proportion of the gamma phase to a substrate comprises the steps detailed in the following sections. In the following, these steps are explained by using the example of the titanium aluminide alloy Ti—48Al—2Nb—2Cr (At. %).

1) Pretreatment of the Substrate Surface

To prepare for the cold spray coating step, the substrate surface is pretreated. It is preferred that the pretreatment of the substrate surface be selected from the methods of polishing, roughness blasting, high pressure water blasting or chemical etching.

In a preferred variant of the roughness blasting, the conditions are selected as follows:

Grit: Al2O3

Grit size: F20-F150 according to the FEPA F42 standard or mesh 20-120 according to ANSI, preferably F150

Jet pressure: Pressure blasting systems: up to a maximum of 4 bar, suction blasting systems: up to a maximum of 6.5 bar Blast distance: Inner diameter 10-20 mm, outer diameter 150-180 mm (depending on the component geometry)

Blast angle: 45-90°

Blast flow rate: 0.5-4 g/min (depending on the nozzle diameter and blasting material)

Robot velocity: at least 100 mm/s, preferably 150-300 mm/s (depending on component/parameter)

Number of transitions: 1-2

Blasting track distance: 0.5-5 mm, preferably 1.0 mm

In a preferred embodiment, the conditions for the high pressure water blasting are selected as follows:

Blasting pressure: 3500 bar

Blasting distance: 20 mm

Blasting angle: 90°

Robot velocity: 1.5 mm/sec

Number of transitions: 2-4

Nozzle shape: concentric

Nozzle speed: 1400 l/min

Blasting track distance: 0.5-5 mm, preferably 1.0 mm

Alkaline solutions, which activate the substrate surface and thus prepare the surface for the subsequent cold spray step, can be used for chemical etching. Alkaline rust removers in an immersion bath, for example, can also be used to activate the substrate surface.

In a particularly preferred embodiment, the chemical etching conditions are selected as follows:

Alkaline cleaner: Bonderite C-AK 4181 AERO

Temperature: 70-80° C.

Cleaning time: 15-20 min

Drying: 10-30 min at 80-100° C.

2) Heat Treatment of the Powder Particles

The phase constitution of the titanium aluminide powder particles is influenced by the heat treatment in such a way that the highest possible proportion of ductile gamma phase is obtained. A high ductility of the powder particles is particularly advantageous for the impact of the powder particles on the substrate and thus for the entire coating process. This is because the increased ductility of the powder particles leads to an increased plastic deformability of the powder particles when they strike the substrate surface. The increased plastic deformation then causes an increased adhesion of the powder particles to the substrate surface and an improved coating efficiency. This increase in adhesion is already noticeable not only at the start of the coating process but also during a further layer build-up.

The above-described properties of the powder particles also lead to a uniform powder conveyance and additionally increase the ductility of the structure of the powder particles.

In order to obtain an optimal coating, the phase constitution of the titanium aluminide particle powder is influenced by a suitable heat treatment in such a way that the highest possible proportion of the gamma phase is obtained. For this purpose, the heat treatment of the titanium aluminide particle powder is carried out in a temperature range from 600 to 1000° C.

The following conditions can be selected to obtain a phase constitution of the titanium aluminide powder particles of approximately 20% alpha2 phase and approximately 80% gamma phase:

Temperature: 650° C.

Duration: 1 hour

Furnace pressure: <10 mbar, preferably <5 mbar (vacuum) or protective gas atmosphere Higher temperatures lead to a higher proportion of the more ductile gamma phase. The heat treatment is preferably carried out in a protective gas atmosphere or under almost vacuum conditions and in a temperature-time window so that no disruptive bonding (due to sintering processes) of the powder particles with one another can occur.

3) Cold Spraying

The basic coating parameters for the titanium aluminide alloy Ti—48Al—2Nb—2Cr (At. %) were calculated prior to the actual performance of the cold spray.

Calculated powder particle sizes: d10/d50/d90: 29/43/61 μm

Powder particle temperature when hitting the substrate: 640-723° C.

Carrier gases: Nitrogen or a mixture of nitrogen and helium

Carrier gas pressure: about 40-50 bar

Gas preheating temperature: 750-1100° C.

Coating distance: 20-60 mm

Powder particle speed: 630-1000 m/s

Eta values are calculated for these coating conditions. The eta value is defined as the ratio of the actual powder particle speed when it hits the substrate ($V_{ist}$) to the critical powder particle speed ($V_{crit}$) and indicates when the ratio $V_{ist}/V_{crit}>1$ has been reached that a layer is being built up. The calculated eta values of 1.11 and 1.18 indicate an adequate cold spray coating by the titanium aluminide powder particles on the substrate made of titanium aluminide alloy with a high proportion of the gamma phase.

Following the calculations, a series of tests were carried out to confirm the calculated results. The test results show that the following coating conditions are optimal for the coating efficiency of the titanium aluminide alloy Ti—48Al—2Nb—2Cr (At. %):

Powder particle fractions: d10/d50/d90: 8/13/19 μm or preferably d10/d50/d90: 18/43/61 μm Powder particle delivery rate: 10-50 g/min Gas preheating temperature: 950-1100° C.

Carrier gas: 100% nitrogen or a mixture of 75% nitrogen and 25% helium

Gas pressure: about 40-50 bar

Coating distance: 20-60 mm

Robot velocity: 500 mm/s

Powder particle speed: 630-1000 m/s

Blasting track distance: 0.5-5 mm, preferably 1.0 mm

4) Thermal Aftertreatment

After the cold spraying, the thermal aftertreatment takes place. This is preferably hot isostatic pressing or alternatively diffusion annealing. Both methods lead to improved adhesion of the applied layer of powder particles to the substrate.

In a preferred embodiment, the following parameters are selected for the hot isostatic pressing:

Temperature: 1200° C.

Time: 4 hours

Pressure: 2000 bar

Protective gas: Argon

The diffusion annealing, however, is preferably carried out at a lower temperature in a range of 700 to 1100° C.

The tests show that the coating efficiencies achieved with the method, according to the invention, are good and, surprisingly, this is also the case with related or similar titanium aluminide alloys. Among other things, this is due to the heat treatment of the powder particles carried out prior to the actual cold spraying. In addition, a further improvement in the adhesive strength and fatigue strength of the applied titanium aluminide alloys is observed.

While embodiments of the invention have been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

The invention claimed is:

1. A method for applying a titanium aluminide alloy on a substrate, the titanium aluminide alloy comprising a gamma phase proportion of at least 50% based on an overall composition of the titanium aluminide, the method comprising:

pretreating a surface of the substrate;

heat treating titanium aluminide powder particles at a temperature range of 600° C. to 1000° C. to increase the proportion of the gamma phase;

cold spraying the heat-treated powder particles onto the substrate or a part of the substrate to form a layer of titanium aluminide; and thermally post-treating the layer of titanium aluminide applied to the substrate.

2. The method according to claim 1, wherein the gamma phase proportion of the titanium aluminide alloy is at least 55% based on the overall composition of the titanium aluminide alloy.

3. The method according to claim 1, wherein the substrate surface comprises a titanium aluminide alloy, a nickel alloy, a titanium alloy, or combinations thereof.

4. The method according to claim 1, wherein the pretreatment of the substrate surface comprises polishing, roughness blasting, high pressure water blasting, chemical etching, or combinations thereof.

5. The method according to claim 1, wherein the heat treatment of the powder particles is carried out in a protective gas atmosphere or in a vacuum.

6. The method according to claim 1, wherein the heat treatment is carried out for a period of 0.5 hours to 5 hours.

7. The method according to claim 1, wherein the heat treatment is carried out in a temperature range from 620° C. to 900° C., and wherein the cold spraying the heat-treated powder particles comprises:

using a carrier gas, conveying the heat-treated powder particles toward the substrate, the carrier gas comprising nitrogen or a mixture of nitrogen and helium, the carrier gas being pre-heated to a temperature of 700° C. to 1200° C., and the carrier gas being provided at a pressure from 40 to 50 bar.

8. The method according to claim 1, wherein the heat treatment is carried out for 1 hour to 3 hours, in a protective gas atmosphere or in a vacuum of less than $10^{-5}$ mbar, and in a temperature range of 650° C. to 850° C.

9. The method according to claim 1, wherein a size of the powder particles is in a range from 10 μm to 70 μm.

10. The method according to claim 1, wherein an average powder particle diameter is less than 45 μm.

11. The method according to claim 1, wherein the powder particles are spherical.

12. The method according to claim 1, wherein the thermally post-treating the layer of titanium aluminide applied to the substrate comprises a hot isostatic pressing or a diffusion annealing.

13. The method according to claim 1, wherein the titanium aluminide alloy comprises the gamma phase and an alpha2 phase, and wherein a ratio of the gamma phase to the alpha2 phase in the titanium aluminide alloy is in a range from 50:50 to 99:1.

14. The method according to claim 1, wherein the gamma phase proportion of the titanium aluminide alloy is at least 60% based on the overall composition of the titanium aluminide alloy.

15. The method according to claim 1, wherein the gamma phase proportion of the titanium aluminide alloy is 80% based on the overall composition of the titanium aluminide alloy.

16. The method according to claim 1, wherein the heat treatment is carried out in a temperature range from 650° C. to 850° C.

17. The method according to claim 13, wherein the ratio of the gamma phase to the alpha2 phase in the titanium aluminide alloy is in a range from 55:45 to 90:10.

18. The method according to claim 13, wherein the ratio of the gamma phase to the alpha2 phase in the titanium aluminide alloy is in a range from 60:40 to 80:20.

* * * * *